US005152618A

United States Patent [19]

Goodwin et al.

[11] Patent Number: 5,152,618

[45] Date of Patent: Oct. 6, 1992

[54] PINCH ROLLER CONTROL IN A PRINTER

[75] Inventors: William D. Goodwin, Rochester; Stanley W. Stephenson, Spencerport, both of N.Y.

[73] Assignee: Eastman Kodak Company, Rochester, N.Y.

[21] Appl. No.: 711,828

[22] Filed: Jun. 7, 1991

[51] Int. Cl.[5] ..... B41J 2/32; B41J 2/00

[52] U.S. Cl. ..... 400/120; 400/641; 400/662

[58] Field of Search ..... 400/636, 636.3, 637, 400/120, 641, 661, 662; 354/303; 101/232; 271/109

[56] References Cited

U.S. PATENT DOCUMENTS

| | | | |
|---|---|---|---|
| 635,609 | 10/1889 | Stickney . | |
| 731,834 | 6/1903 | Anderson . | |
| 888,556 | 5/1908 | Van Slyke . | |
| 1,336,379 | 8/1921 | Stickney . | |
| 2,719,472 | 10/1955 | Land | 354/303 |
| 3,925,800 | 12/1975 | Whall | 354/301 |
| 4,621,271 | 11/1986 | Brownstein | 346/76 PH |
| 4,639,739 | 1/1987 | Tsutsumi | 400/120 |
| 4,900,175 | 2/1990 | Ikeda et al. | 400/659 |
| 4,976,558 | 12/1990 | Kuzuya et al. | 400/615.2 |

FOREIGN PATENT DOCUMENTS

| | | |
|---|---|---|
| 57-140177 | 8/1982 | Japan . |
| 1441348 | 6/1976 | United Kingdom . |

OTHER PUBLICATIONS

"Rigid Foam Platen" (G. A. Duggins et al), *IBM Technical Disclosure Bulletin,* vol. 17, No. 4, Sep. 1974 at p. 115.

"Mechanisms of Color Formation on Thermo-Sensitive Paper" by A. Igarashi et al, *Advances in Non-Impact Printing Technologies for Computer and Office Applications,* Edited by J. Gaynor, Van Nostrand Reinhold Company, 1982, pp. 886–892.

"A Pulse Count Modulation: A Novel Head Drive Method for Thermal Printing" (M. D. Fiscella et al), *Hard Copy and Printing Technologies* by K-I Shimazu, Col. 1252, Proceedings SPIE, Feb. 13–14, 1990, Santa Clara, CA, pp. 156–167.

*Primary Examiner*—J. Reed Fisher
*Assistant Examiner*—Anthony H. Nguyen
*Attorney, Agent, or Firm*—Raymond L. Owens

[57] ABSTRACT

A printing mechanism such as a thermal printer includes a rotatable cylindrical platen having a circumference which is smaller than the printing length of a complete image to be reproduced on a print medium, and at least one pinch roller. The platen has a width which is wider than a width of the print medium. The platen includes a rigid central longitudinally-disposed shaft, a cylindrical elastomeric layer formed around a central logitudinal section of the shaft, and first and second opposing cyclindrical registration members. The first and second registration members are fixedly coupled to the shaft and engage a first and a second end of the elastomeric layer, respectively, so that the shaft, layer, and members rotate together. Each pinch roller is formed of a rigid material and is disposed longitudinally to the platen. Each pinch roller is forced radially towards the platen by a suitable forcing means to engage (a) the registration members in the absence of a print medium between the pinch roller and the elastomeric layer, and (b) just engage the surface of the print medium opposite the elastomeric layer during a printing process.

14 Claims, 4 Drawing Sheets

PINCH ROLLER CONTROL IN A PRINTER

FIELD OF THE INVENTION

The present invention relates to techniques for controlling pinch rollers which are located around the periphery of a platen of a printer and provide forced contact with either the platen during a non-printing period or a print medium placed on the platen during a printing period.

BACKGROUND OF THE INVENTION

Platens are used in various printing machines to support a print medium (e.g., paper) while the printing machine produces the desired text and/or graphics on the print medium. Platens are generally made with a rigid cylindrical central shaft and a semi-rigid compliant printing layer surrounding the outer surface of the shaft. Such compliant printing surface is formed of a material, or a composition of materials, that provides sufficient friction to control the movement of the print medium thereon as the platen rotates about its longitudinal axis. In typewriting machines, the semi-rigid compliant printing layer is chosen to also provide sound deadening qualities and minimal deformation as the type forming the characters impacts the print medium. In this regard see, for example, U.S. Pat. No. 731,834 (F. F. Anderson), which issued on Jun, 23, 1903, U.S. Pat. No. 4,900,175 (H. Ikeda et al.), which issued on Feb. 13, 1990, and the article entitled "Rigid Foam Platen" by G. A. Duggins et al. in the IBM Technical Disclosure Bulletin, Vol. 17, No. 4, Sep. 1974 at page 1115.

Platens are also used in non-impact printers such as ink-jet printers. Non-impact printers are so called because their printing mechanism does not touch the paper or print medium. More particularly, ink-jet printers use electrically charged ink droplets that are sprayed between electrically charged deflection plates to direct the ink droplets and form the desired image on the print medium disposed on a platen. Thermal printers, on the other hand, typically use a specially-coated heat-sensitive print medium, such as paper, which moves between a platen and a thermal print head. The thermal print head comprises, for example, a linear array of heating elements (forming individual pixels) which contact the heat-sensitive print medium with a predetermined amount of pressure. The heating elements are then energized so as to provide a predetermined amount of heat to each pixel area. The heat from each of the energized heating elements reacts with the heat-sensitive print medium therebeneath to form a separate pixel of the desired image. The next line of pixels of the desired image are formed by advancing the platen, and the print medium thereon, by a predetermined distance passed the thermal print head. In certain heat-sensitive or thermosensitive papers, as explained in the article entitled "Mechanisms of Color Formation On thermo-sensitive Paper" by A. Igarashi et al. in the book *Advances In Non-Impact Printing Technologies For Computer and Office Applications*, Edited by J. Gaynor, Van Nostrand Reinhold, Company, 1982, at pages 886–892, a thermo-sensitive layer of certain components is provided on the paper. The subsequent predetermined heating of each pixel (via a heater element on a thermal print head) changes the light absorption characteristics of the thermo-sensitive layer.

In certain thermal printers, a dye receiving member is fed onto a platen and then a dye bearing web is placed in contact with the dye receiving member. As the platen rotates, the dye receiving member and the dye bearing web thereon are brought under the thermal print head. Heat from the thermal print head transfers a predetermined amount of dye from the dye bearing web to the dye receiving member. The dye receiving member and dye bearing web are advanced a predetermined number of increments until a complete image layer has been deposited. In these applications, the overall image may require multiple dye layers to be deposited on the dye receiving member, such as in the creation of continuous tone sublimation dye images. The overall image quality where multiple overlapping dye layers are used is dependent on the registration of each of the dye layer to each of the other overlapping dye layers.

The article entitled "Pulse Count Modulation: A Novel Head Drive Method For Thermal Printing" by M. D. Fiscella et al. in the publication *Hard Copy and Printing Technologies*, Volume 1252, Proceedings of the SPIE, Feb. 13–14, 1990, Santa Clara, Ca. at pages 156–167, discusses a continuous tone thermal dye diffusion printer designed by the Eastman Kodak Company using a pulse count modulation thermal print head drive. In the printing process, a hot heater element of the thermal print head diffuses dye from a donor sheet into a dye receiving member (e.g., resin coated paper) to form a pixel of a desired image. In thermal dye diffusion printing, the amount of dye transferred to a pixel, and the optical density level of the pixel, are a function of the amount of heat produced at a given heater element and the length of time the heater element is hot.

In certain printers such as continuous tone thermal dye diffusion printers, several dye layers must be deposited to produce the desired image. The fore, after a dye layer has been deposited, the dye receiving member is returned to a starting position for each succession dye layer. It is desirable that each successive dye layer precisely overlay the preceding dye layers for optimum image quality. Because prior art platens are typically covered with an elastomer, a certain amount of mis-registration results from the rewinding operation.

Additionally, in certain printers it is desirable that the diameter of the rotating platen be as small as possible. With small diameter elastomeric coated platens, it is usually impossible to fixedly clamp the dye receiving member to the platen because the circumference of the platen is smaller than the length of the image to be produced. In a first known embodiment using small diameter elastomeric coated platens, the dye receiving member is brought to a starting position across the platen, and a dye layer is produced along the dye receiving member. For each succeeding dye layer application, the platen and the dye receiving member are counter-rotated the same degree, or amount of rotation, as was performed during printing of each prior dye layer. It is found that with the above-described counter-rotating method, the dye receiving member does not return to the exact same starting position each time. This mis-registration is due to the compliant nature of the elastomeric coating of the platen.

In a second known embodiment using small diameter platens, the dye receiving member movement is controlled by external, hard surface, capstan drive print rollers that reduce the mis-registration found in platen rewind printers. With the additional capstan print rollers, the overall printing mechanism is necessarily more complex and expensive. Additionally, such print mechanism produced a large non-printed area on the dye receiving member, which area is at least equivalent to the distance between the printing "nip" (where the dye receiving member engages the platen and the thermal print head) and the capstan "nip" (where the dye receiving member engages the external capstan roller).

With most printers, pinch rollers are used at one or more areas around a platen to provide a force against the print medium and, in turn, the compliant material of the platen during the printing process. However, at the conclusion of the printing process, if the pinch roller remains in forced contact with the compliant platen, the platen takes a permanent set, or dent, in that area. In subsequent printing operations the image produced on the print medium experiences a perceptible loss of density in the area of the dent. Therefore, to avoid such loss of density, prior art printers include mechanisms which pull the pinch rollers from the platen during non-printing periods to avoid producing dents in the platen.

It is desirable to have a simple and inexpensive printer which provides a good quality of registration while avoiding the need for capstan roller mechanisms, and which prevents the production of dents in the platen.

SUMMARY OF THE INVENTION

The present invention is directed to providing a simple and inexpensive printer which (1) avoids the production of permanent sets or dents in a platen during non-printing periods, (2) the need for a pinch roller retraction mechanism during the non-printing periods, and (3) provides pinch rollers that supply a sufficient force on a print medium on the platen to provide good registration between multiple dye layers of a complete image during a printing period. More particularly, the present invention relates to a printing mechanism for reproducing an image on a print medium. The printing mechanism comprises a cylindrical rotatable platen for contacting and supporting the print medium on which a complete image is to be reproduced, and at least one cylindrical rotatable pinch roller. Each pinch roller has a longitudinal axis thereof disposed substantially parallel to the longitudinal axis of the platen. The platen comprises a rigid shaft disposed along a longitudinal axis of the platen, a cylindrical elastomeric layer comprising a predetermined axial compliancy which is formed around a central longitudinal section of the rigid shaft, a first rigid cylindrical registration member which fixedly engages the rigid shaft and a first end of the elastomeric layer, and a second rigid cylindrical registration member which fixedly engages the rigid shaft and a second end of the elastomeric layer. The circumference of each of the first and second registration members matches the circumference of the first and second end of the elastomeric layer, respectively. The at least one cylindrical rotatable pinch roller has a longitudinal axis which is disposed substantially parallel to the longitudinal axis of the platen. Each pinch roller is formed of a rigid material, and comprises a first and a second bearing located at a first and second end of the pinch roller, respectively, and means for forcing the pinch roller substantially radially towards the outer surface of the platen. Each bearing rides in a bearing guide formed in a housing of the printer. The forcing means provides forced contact of the pinch roller against an outer surface of each of the first and second registration members in the absence of a print medium, and against just the print medium when the print medium is present between the pinch roller and a central section of the elastomeric layer.

In a preferred embodiment, the printing mechanism is a thermal printer comprising a cylindrical rotatable platen for contacting and supporting the print medium on which a complete image is to be reproduced, at least one cylindrical rotatable pinch roller, and a thermal print head. The platen comprises a rigid shaft disposed along a longitudinal axis of the platen, a cylindrical elastomeric layer comprising a predetermined axial compliancy which is formed around a central longitudinal section of the rigid shaft, a first rigid cylindrical registration member which fixedly engages the rigid shaft and a first end of the elastomeric layer, and a second rigid cylindrical registration member which fixedly engages the rigid shaft and a second end of the elastomeric layer. The circumference of each of the first and second registration members matches the circumference of the first and second end of the elastomeric layer, respectively. Each pinch roller has a longitudinal axis thereof disposed substantially parallel to the longitudinal axis of the platen. Each pinch roller is formed of a rigid material, and comprises a first and a second bearing located at a first and second end of the pinch roller, respectively, and means for forcing the pinch roller substantially radially towards the outer surface of the platen. Each bearing rides in a bearing guide formed in a housing of the printer. The forcing means provides forced contact of the pinch roller against an outer surface of each of the first and second registration members in the absence of a print medium, and against just the print medium when the print medium is present between the pinch roller and a central section of the elastomeric layer. The thermal print head comprises a plurality of heating elements disposed in a predetermined pattern. The plurality of heating elements being arranged to selectively contact the print medium on the platen during a printing process.

The invention will be better understood from the following more detailed description taken with the accompanying drawings and claims.

The drawings are not necessarily to scale.

DETAILED DESCRIPTION

Figure 1:
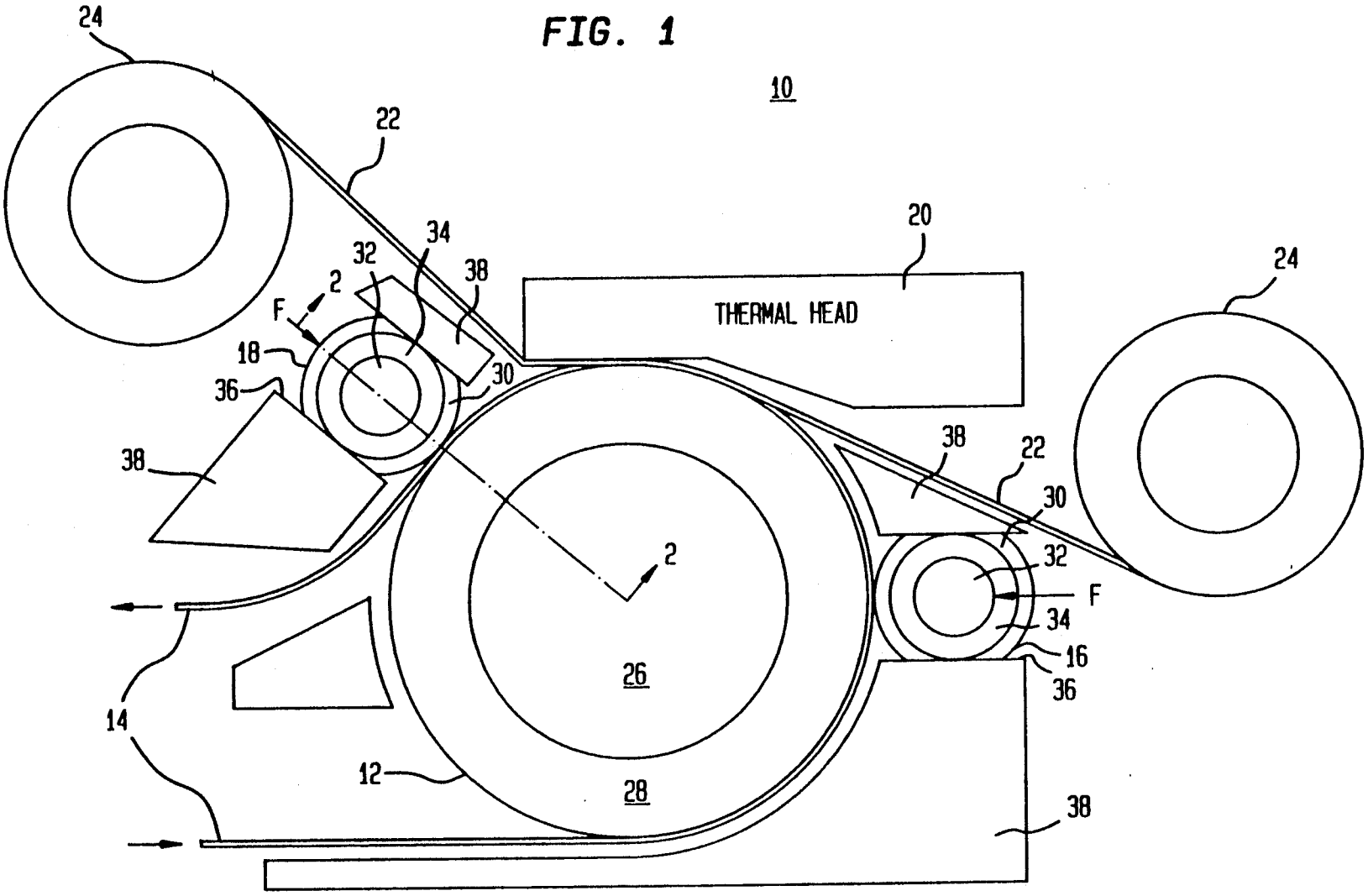
FIG. 1 is a cross-sectional side view at a right-hand end of a continuous tone dye diffusion thermal printer in accordance with the present invention.

Referring now to FIG. 1, there is shown cross-sectional view at a right-hand end of a thermal head and capstan apparatus 10 for a continuous tone dye diffusion thermal printer in accordance with the present invention. The apparatus 10 comprises a platen 12, a dye receiving member (e.g., paper) 14, a first pinch roller 16, a second pinch roller 18, a thermal print head 20, and a dye bearing web 22 running between a pair of reels 24. The platen 12 comprises a central rigid core or shaft 26 made of steel or other rigid material surrounded in a longitudinally central section thereof by a layer 28 of an elastomeric material such as silicon rubber or a urethane derivative. Located at each end of the shaft 26 adjacent the end of the layer 28 is a registration member 40 (not shown in FIG. 1) which will be discussed in detail hereinafter with the discussion of FIGS. 2 and 3.

The dye receiving member 14 is wrapped around a portion of an outer surface of the elastomeric layer 28 of the platen 12 at least in the area between the first and second pinch rollers 16 and 18 and adjacent the thermal print head 20. A first side of the dye bearing web 22 is positioned in contact with the exposed surface of the dye receiving member 14, and the thermal print head 20 is then placed in forced contact with the opposing side of the web dye bearing 22. The combination of the dye receiving member 14 and the dye bearing web 22 will hereinafter be referred to as a print media for reproducing a desired image on the dye receiving member 14.

Each of the pinch rollers 16 and 18 comprises a central longitudinal rigid section 30 (shown in FIGS. 2 and 3) which steps down to a smaller diameter end section 32 (shown in FIGS. 2 and 3) at each end of the central section 30. A separate bearing member S4 is positioned on each of the end sections 32 which rides in a slot 36 of a printer housing 38. The slot is preferably arrange radially to the platen 12. Means (not shown) are provided for applying a predetermined force F on each of the bearing members 34 for forcing the central section 30 towards the platen 12.

In operation, the dye receiving member 14 is fed around at least a portion of the outer surface of the elastomeric layer 28 of the platen 12 including the area under and between the first and second pinch rollers 16 and 18 and the area adjacent thermal print head 20. The pinch rollers 16 and 18, the elastomeric layer 28 on platen 12, and any tension on the dye receiving member 14 ensure that the dye receiving member 14 is maintained in contact with the outer surface of the elastomeric layer 28 of the platen 12. The dye bearing web 22 is then positioned adjacent to the dye receiving member 14, and the thermal print head 20 is placed in forced contact with the dye bearing web 22. In other words, the two parts of the thermal print media of member 14 and web 22 are passed between a print "nip" (the compressed area) formed between the thermal print head 20 and the platen 12. A plurality of heating elements (not shown) form, for example, a linear array of heating elements of the thermal print head 20 which are positioned in forced contact with the dye bearing web 22. Once the above-described configuration is achieved, the printing operation is started.

In the printing operation, each of the plurality of heating elements of the linear array of heating elements (not shown) of the thermal print head 20 are individually energized depending on the pattern of a desired image (or dye) layer to be reproduced along the dye receiving member 14. More particularly, the thermal print head 20 can comprise a linear arrangement of a plurality of resistive elements (not shown) which are selectively energized so as to cause different quantities of dye to be transferred onto the dye receiving member 14 as the thermal print media of member 14 and web 22 passes through the print "nip". In other words, the amount of heat from each heating element causes a predetermined amount of dye from the dye bearing web 22 therebeneath to be transferred to the dye receiving member 14. Such transfer forms a separate image pixel of the image layer on the dye receiving member 14. It is to be understood that when a heating element is no selectively heated no dye will be transferred to the dye receiving member 14 from the dye bearing web 22 during the production of that image pixel. When all of the image pixels of a line have been formed across the dye receiving member 14, the dye receiving member and the dye bearing web 22 have moved forward in a first direction by a predetermined distance to permit the next adjacent line of image pixels of an overall image layer to be formed in a similar manner. The image layer of a desired overall image is completed when all of the adjacent lines of image pixels have been transferred to the dye receiving member 14 during one pass beneath the thermal print head 20.

In certain thermal printers, such as where continuous tone sublimation dye images are formed, multiple overlaid image layers must be printed to form the complete image. With such thermal printers, it is necessary to rewind the dye receiving member 14 in order to overlay each successive image layer on each of the prior formed image layer or layers. It must be understood that the quality of the complete image is dependent on the registration of each image layer with each of the other image layers.

For resistive element printing, the contact force of the thermal print head 20 on both the dye bearing web 22 and the dye receiving member 14 can be in the order of 1 to 2 pounds of force per linear inch of the thermal print head. For thermal print heads 20 having a length of from 8 to 10 inches, the resulting head forces on the platen 12 and print media of member 14 and web 22 are sufficient to induce a worst-case mis-registration between successive image layers of from 0.005 to 0.020 inches. In high resolution printing, where heating elements of the thermal print head 20 are 0.005 inches square, the above data represents pixel misregistration on the order of from 1 to 4 pixels. In certain applications, this results in unacceptable quality of overall desired images.

Additionally, in the case of small diameter platens 12, which typically have an outer diameter of between 20 and 25 millimeters, it is impossible to fixedly clamp the dye receiving member 14 to the platen 12 to avoid mis-registration because the length of the complete image to be printed is greater than the circumference of the platen 12. When the dye receiving member 14 is rewound back to the starting position of a complete image by counter-rotating the platen 12 by a same degree of rotation as was accomplished during printing to form a successive image layer, a mis-registration generally occurs due to the compliant nature of the elastomeric layer 28 on platen 12. It must be understood that to minimize mis-registration from other sources during the rewinding operation when the thermal print head 20 is lifted (by means not shown) from the print media 14 and 22, the dye receiving member 14 must be kept in frictional contact with the platen 12. Such frictional contact minimizes any slippage between the dye receiving member 14 and the platen 12 during the rewinding operation. The continued frictional contact of the dye receiving member 14 with the platen 12 is accomplished by the use of the pinch rollers 16 and 18 which are disposed on either side of the print "nip" area adjacent the thermal print head 20.

Mis-registration between image layers can be substantially avoided by using external, hard-surface, rollers (not shown) which meter the dye receiving member 14, as is known in the prior art. Such external rollers produce a more complex and expensive capstan drive mechanism in the printer.

Figure 2:
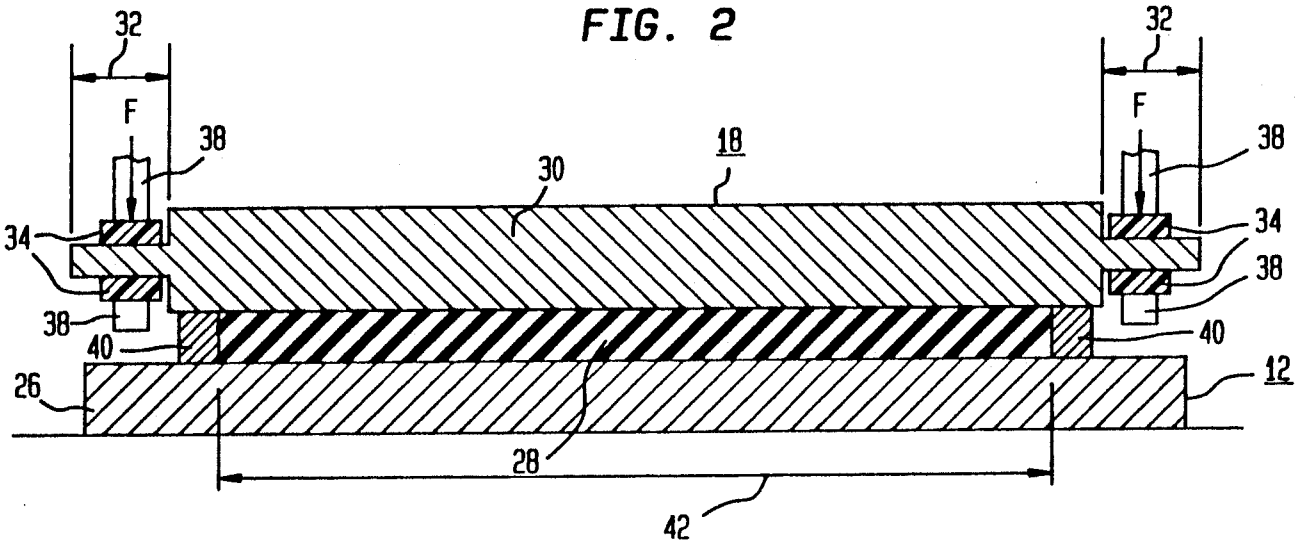
FIG. 2 is a front cross-sectional view along the dashed line 2—2 of the thermal printer of FIG. 1 as seen during a non-printing period when a dye receiving member is not located between a platen and a pinch roller of the printer.

Referring now to FIG. 2, there is shown a front cross-sectional view along dashed line 2—2 of FIG. 1 which shows the platen 12, and the second pinch roller 18 in accordance with the present invention without the dye receiving member 14 positioned therebetween. This configuration shows the platen 12 and the pinch roller 18 as found in a non-printing mode. The platen 12 is shown as comprising the cylindrical elastomeric layer 28 disposed along a predetermined central section 42 (illustrated by the long horizontal line with arrows on both ends) of the shaft 26, and first and second rigid cylindrical registration members 40 coupled to the shaft 26 adjacent opposite ends of the elastomeric layer 28. The outer circumference of the registration members 40 have the same shape and the substantially equivalent diameter as an outer circumference of the elastomeric layer 28. The registration members 40 are made of any suitable rigid material such as a hard plastic or metal. The shaft 26 of the platen 12 extends beyond the outer edges of the first and second registration members 40 for connection at either end to a drive means (not shown).

In accordance with a preferred embodiment of the present invention, the pinch roller 18 (and also the pinch roller 1 6) comprises a rigid cylindrical core 30 with opposing stepped down end sections 32 (illustrated by the horizontal line with arrows on both ends), and a separate cylindrical bearing member 34 mounted on the outer surface of each of the stepped down end sections 32. The core 30 can be made of any suitable rigid material such as a metal, and the bearing member 34 can be made of any suitable rigid material such as a hard plastic or a metal.

In the non-printing state with no dye receiving member positioned between the elastomeric layer 28 of the platen 12 and the core 30 of the pinch roller 18, the predetermined force F on each of the bearing members 34 pushes the pinch roller 18 radially onto the outer surface of the platen 12. More particularly, the outer surface of the core 30 of the pinch roller 18 rides on the rigid registration members 40. If the elastomeric layer 28 has the same diameter as the registration members 40, the pinch roller also contacts the elastomeric layer 28. It is to be understood that the rigid cylindrical core 30 of the pinch roller 12 rides on each of the rigid registration members 40 on either end of the platen 12. Therefore, the core 30 cannot compress the elastomeric layer 28 during the non-printing period when the platen 12 and pinch roller are not turning. Since the pinch roller does not compress the elastomeric layer 28, a permanently set cannot occur in the surface of the elastomeric layer 28 to form a dent therein. Such platen and pinch roller configuration prevents a subsequent case a loss of image density on the dye receiving member 14 in the area of the dent during a subsequent printing period.

Figure 3:
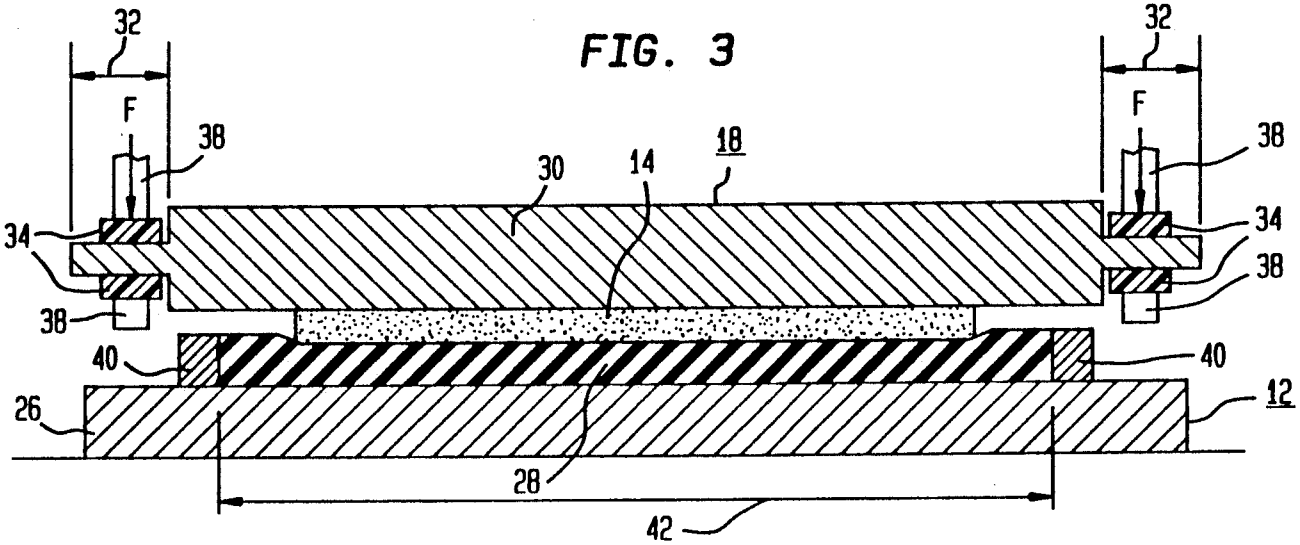
FIG. 3 is a front cross-sectional view along dashed line 2—2 of the thermal printer of FIG. 1 as seen during a printing period when a dye receiving member is located between the platen and the pinch roller.

Referring now t o FIG. 3, there is shown a front cross-sectional view along dashed line 2—2 of FIG. 1 which shows the platen 12, and the second pinch roller 18 with the dye receiving member 14 positioned therebetween during a printing period. Since the platen and the pinch roller of FIG. 3 are the same as the platen 12 and the pinch roller 18 of FIG. 2, the same corresponding portions of these components have the same reference numbers. The dye receiving member 14 has a significant thickness of, for example, 0.18 millimeters which causes the pinch roller 18 to be raised off of the registration members 40 of the platen 12 as the member 14 passes between the pinch roller 18 and the elastomeric layer 28. It must be understood that the pinch roller 18 is only pressing down on the dye receiving member 14 during the printing period. Therefore, the dye receiving member 14 is pressed into the elastomeric surface by a predetermined amount (e.g., 50 to 75 microns), typically referred to as a "sink", which must be less than the thickness of the member 14.

Figure 5:
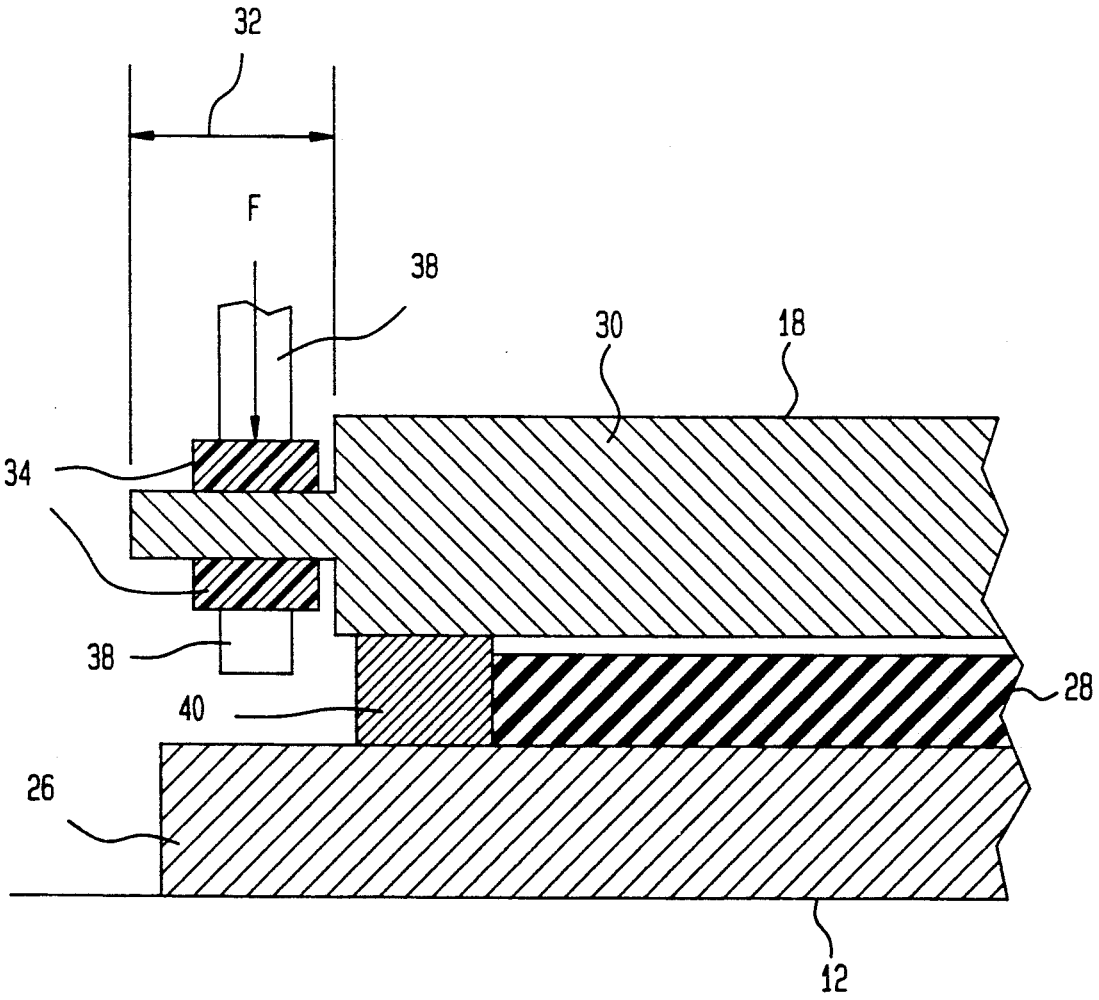
FIG. 5 is a partial enlarged front cross-sectional view of the left side of the thermal printer of FIGS. 2 and 3 showing a difference in diameter between a cylindrical registration member and a cylindrical elastomeric layer of the platen.

In accordance with the present invention, the dye receiving member 14, or any other print medium used, should have a significant thickness which causes a slight gap (e.g., a thousand of an inch or more) to occur between the pinch roller 18 (and similarly the pinch roller 16) and the registration members 40 when the dye receiving member 14 is present between the roller 18 and the elastomeric layer 28. In an alternative embodiment to the platen and pinch roller arrangement shown in FIGS. 2 and 3, the elastomeric layer 28 can have an outer diameter which is slightly less (e.g., 13 microns) than the outer diameter of the registration members 40 (as shown in FIG. 5). A requirement of the present invention is that the amount of "sink" of the print medium 14 into the elastomeric layer 28 should be less than the thickness of the print medium used. Such condition causes the pinch rollers 16 and 18 to be raised above the registration members 40 by a slight distance when the print medium is inserted between the elastomeric layer 28 and the pinch roller 16 or 18. It is to be understood that the amount of force imposed on the bearings 34 of the pinch rollers 16 and 18, and the axial compliancy of the elastomer used in the layer 28, determines the amount of "sink" of the print medium 14 into the elastomeric layer 28.

The placement of a radial force on the bearing members 40 of the pinch rollers 16 and 18 towards the platen 12 can be accomplished using any suitable means. For example, a first technique is to place a separate flexible strap of metal (not shown) against each of the bearings 34 to cause the bearing 40 to be pushed radially in the slot 36 towards the platen 12. A first technique uses a screw (not shown) as a force changing means which is rotatably positioned in a mounting above and has the end thereof engaging the surface of the flexible strap of metal between the point of contact with the bearing and the opposite end, which is secured to the printer housing 38. The rotation of the screw in the mounting causes the metal strap to bend more or less (depending on the rotation of the screw) and cause a change in the force on the bearing 40. A second technique is to spring load the bearing 40 so as to apply a force radially in the direction of the platen 12, and includes means for variably changing the force imparted by the spring on the bearing 40.

The present inventive apparatus shown in FIGS. 2 and 3 avoids mis-registration between multiple image layers without the need for external metering rollers. Additionally, the present inventive apparatus avoid the requirement of mechanisms that lift the pinch rollers from the platen during non-printing periods to avoid a permanent set in the elastomeric surface 28 of the platen 12. More particularly, increasing the pressure that is placed on the bearings 40 causes an increase in the pressure placed on the dye receiving member 14. Such increased pressure on the dye receiving member 14 causes significantly reduced slippage between the elastomeric surface 28 and the dye receiving member 14 during rotation of both of the platen and the pinch rollers 16 and 18, and, in turn, results in less misregistration between multiple image layers. Additionally, the use of the rigid registration members 40 for contacting spaced-apart sections of the pinch rollers 16 and 18 during non-printing periods prevents the pinch rollers from sinking into or deforming the elastomeric layer 28 for any period of time. This obviates the need for mechanisms to lift the pinch rollers 16 and 18 from the platen 12 during the non-printing periods.

The present pinch roller 16 and 18 and platen 12 design also takes into account what is known as "exact design constraint." More particularly, when a mechanism is designed, tight tolerances of a few thousands of an inch may be incorporated in various sections of the design of the mechanism. The design of such tight tolerances in the mechanism usually results in a great expense to achieve proper operation of the design. The present pinch roller 16 and 18 and platen 12 design obviates the need for tight tolerances in and between the various components and subcomponents. Therefore, the present pinch roller and platen designs permit them to be placed together without consideration of narrow tolerances and thereby achieve proper operation without great expense.

Figure 4:
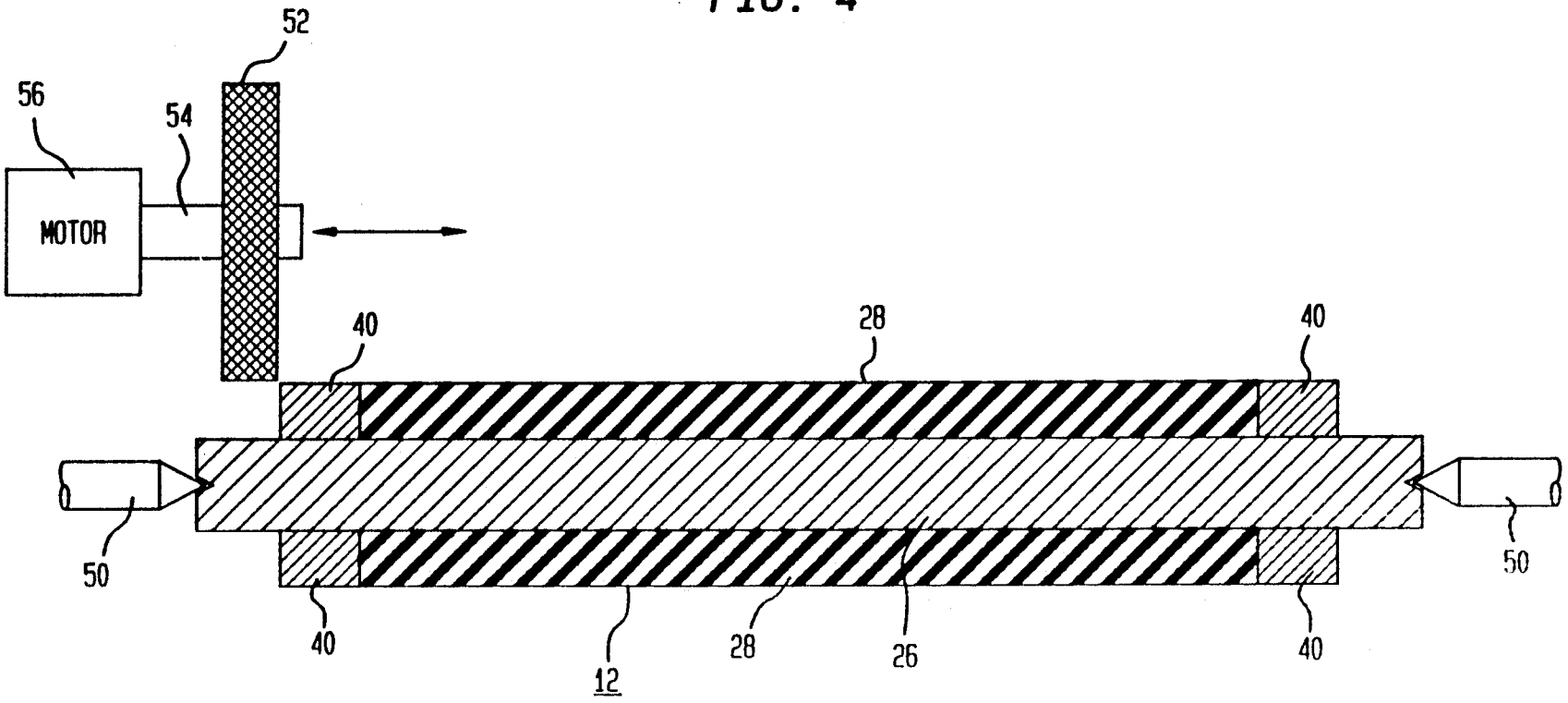
FIG. 4 is an apparatus for finishing the platen of FIGS. 2 and 3.

Referring now to FIG. 4, there is shown a front cross-sectional view of a grinding technique for finishing the outer surface of the platen 12 of FIGS. 2 and 3. In manufacture, the registration members 40 are first fixedly mounted near opposite ends of a shaft or core 26 of the platen 12. An elastomer is then molded around the shaft 26 between the registration members 40 to form the elastomeric layer 28. Typically, an elastomer is so amorphous that it is difficult to originally mold the elastomer onto the shaft 26 to the typically required tolerance of 50 microns. Therefore, the outer surface must always be ground.

For the grinding technique of FIG. 4, a separate "center" 50 comprising a metallic rod with a cone-shaped end is positioned so the cone-shaped end thereof fixedly engages a similar conic shaped depression in the center of each end of the shaft 26. This apparatus permits the centers 50 and the shaft 26, with the elastomeric layer 28 and the registration members thereon, to be rotated by means (not shown). An abrasive wheel 52 is mounted on a shaft 54 of a motor 56. The motor 56 is energized to spin the abrasive wheel 52 in a first direction at the same time as the platen 12 is spun by a drive means (not shown) in a second direction typically opposite to the first direction. While the abrasive wheel 52 and the platen 12 are spinning, the abrasive wheel 52 is moved longitudinally along the plate 12 in order to cut a predetermined small amount from the outer surface of the platen. The abrasive wheel is moved back and forth along the outside of the platen 12 and incremented towards the platen with each pas until the platen achieves the desired outer diameter.

It must be understood that when the platen 12 is rotated using rigid centers 50 to engage the shaft 26, a wobble in the platen generally occurs because the centers are not precisely located at the center of the shaft. It has been found that the platen 12 usually wobbles very slightly by an offset of about 25 microns. This is technically called the "runout of the machine." Because of the "runout of the machine", a perfectly concentric round outer surface of the platen 12 is not obtained during the grinding process. Instead, a slightly egg-shaped configuration is obtained when looking at an end section of the platen 12. With the platen 12 comprising the spaced-apart registration members 40 and the elastomeric layer 28, the grinding operation causes both the registration members and the elastomeric layer to have that egg-shaped cross-sectional configuration. It is to be understood that each of the egg-shaped registration members 40 act as a cam surface for the pinch rollers 16 and 18. Since the registration members 40 are ground at the same time as the elastomeric layer 28, the cam surface of the registration members 40 is an indicator of the eccentricity of the platen 12. Therefore, the circumference of the registration members matches the circumference of the elastomeric layer 28 when proceeding around the platen 12.

It is to be understood that the specific embodiments described herein are intended merely to be illustrative of the spirit and scope of the invention. Modifications can readily be made by those skilled in the art consistent with the principles of this invention. For example, the platen can also include thin cylindrical end cups and rigid torsion couplings as are disclosed in our copending U.S. patent application Ser. No. 711,687, entitled "Capstan Bodies in Printer Rollers", and filed concurrently as this patent application. More particularly, the copending patent relates to a printing mechanism such as a thermal printer which includes an elastomer coated platen having a circumference smaller than the printing length of an image to be reproduced on a print medium. The platen has a width which is wider than the width of the print medium. The platen includes a rigid central longitudinally-disposed shaft, and opposing end sections. Each end section extends under the nearest edge of the print medium from an associated end of the platen, and includes means for coupling a contacting print medium to a rotation of the shaft. In a preferred embodiment, the coupling means is formed of a non-elastomeric thin-walled cup either disposed near the surface of the platen within the elastomer coating or at the surface of the platen with a thin layer of fine grit particles formed thereon. Each thin-walled cup is fixedly connected to the shaft by a rigid torsion coupling member which is similar to the present registration members 40.

What is claimed is:

1. A printing mechanism for reproducing a complete image on a print medium comprising:

a cylindrical rotatable platen comprising a cylindrical shaft formed of a rigid material which is disposed along a longitudinal axis of the platen, (b) a cylindrical elastomeric layer of a substantially uniform thickness comprising a predetermined axial compliancy which is formed around a central longitudinal section of the shaft for contacting and supporting the print medium on which the complete image is to be reproduced, the print medium having a width which is less than the central longitudinal section of the shaft, (c) a first cylindrical registration member formed of a rigid material which fixedly engages the shaft and a first end of the elastomeric layer, and (d) a second cylindrical registration member formed of a rigid material which fixedly engages the shaft and a second end of the elastomeric layer, a diameter of each of the first and second registration members at least matching a diameter of the first and second end of the elastomeric layer, respectively:

a print housing comprising first and a second spaced-apart bearing guides; and at least one cylindrical rotatable pinch roller, each pinch roller being formed of a rigid material having a longitudinal axis disposed substantially parallel to the longitudinal axis of the platen and comprising (a) a first and second bearing located at a first and second end of the pinch roller, respectively, which each ride in a separate one of the first and second bearing guides of the print housing of the printer, and (b) means for forcing each pinch roller substantially radially towards the outer surface of the platen for forced contact against the outer surface of the first and second registration members so as to avoid compression of the elastomeric layer in the absence of a print medium, and against just the print medium when the print medium is present between the pinch roller and a central section of the elastomeric layer.

2. The printing mechanism of claim 1 wherein a circumference of the platen is smaller than a printing length of an image to be reproduced on the print medium.

3. The printing mechanism of claim 1 wherein the diameter of the elastomeric layer matches the diameter of each of the first and second registration members.

4. The printing mechanism of claim 1 wherein:

the diameter of the elastomeric layer is less than the diameter of each of the first and second registration members; and the difference between the diameter of the elastomeric layer and the diameters of the first and second registration members being less than a thickness of the print medium being used for causing the pinch roller to be raised above the registration members in the presence of the print medium between the pinch roller and a central section of the elastomeric layer.

5. The printing mechanism of claim 1 wherein the forcing means of each pinch roller is adjustable to vary the force of the pinch roller towards the platen.

6. The printing mechanism of claim 1 wherein:

the shaft of the platen extends outside of the first and second registration members; and the mechanism further comprises a driving means coupled to the shaft of the platen for selectively rotating the platen by predetermined amounts.

7. The printing mechanism of claim 1 wherein the printing mechanism is a thermal printer further comprising a thermal print head comprising a plurality of heating elements disposed in a predetermined pattern, the plurality of heating elements being arranged to selectively contact the print medium on the platen during a printing process.

8. The printing mechanism of claim 7 wherein the mechanism further comprises a driving means coupled to the shaft of the platen for selectively rotating the platen by predetermined increments.

9. A thermal printing mechanism for reproducing an image on a print medium comprising:

a cylindrical rotatable platen comprising a shaft formed of a rigid material disposed along a longitudinal axis of the platen, (b) a cylindrical elastomeric layer comprising a predetermined axial compliancy which is formed around a central longitudinal section of the shaft for contacting and supporting the print medium on which the image is to be reproduced, the print medium having a width which is less than the central longitudinal section of the shaft, (c) a first cylindrical registration member formed of a rigid material which fixedly engages the shaft and a first end of the elastomeric layer, and (d) a second cylindrical registration member which fixedly engages the shaft and a second end of the elastomeric layer, a diameter of each of the first and second registration members at least matching a diameter of the first and second end of the elastomeric layer, respectively;

a print housing comprising first and a second spaced-apart bearing guides;

at least one cylindrical rotatable pinch roller, each pinch roller being formed of a substantially non-deformable material having a longitudinal axis disposed substantially parallel to the longitudinal axis of the platen and comprising (a) a first and second bearing located at a first and second end of the pinch roller, respectively, which each ride in a separate one of the first and second bearing guides of the print housing of the printer, and (b) means for forcing each pinch roller substantially radially towards the outer surface of the platen for forced contact against the outer surface of the first and second registration members so as to avoid compression of the elastomeric layer in the absence of a print medium, and against just the print medium when the print medium is present between the pinch roller and a central section of the elastomeric layer; and a thermal print head comprising a plurality of heating elements disposed in a predetermined pattern, the plurality of heating elements being arranged to selectively contact the print medium on the elastomeric layer of the platen during a printing process.

10. The printing mechanism of claim 9 wherein a circumference of the platen is smaller than a printing length of an image to be reproduced on the print medium.

11. The printing mechanism of claim 9 wherein the diameter of the elastomeric layer exactly matches the diameter of each of the first and second registration members.

12. The printing mechanism of claim 9 wherein:

the diameter of the elastomeric layer is less than the diameter of each of the first and second registration members; and the difference between the diameter of the elastomeric layer and the diameter of the first and second registration members being less than a thickness of the print medium being used for causing the pinch roller to be raised above the registration members in the presence of the print medium between the pinch roller and a central section of the elastomeric layer.

13. The printing mechanism of claim 9 wherein the forcing means of each pinch roller is adjustable to vary the force of the pinch roller towards the platen.

14. The printing mechanism of claim 9 wherein:

the shaft of the platen extends outside of the first and second registration members; and the mechanism further comprises a driving means coupled to the shaft of the platen for selectively rotating the platen by predetermined amounts.

* * * * *